US010366680B2

(12) United States Patent
Hirasawa

(10) Patent No.: US 10,366,680 B2
(45) Date of Patent: Jul. 30, 2019

(54) ANTI-LOOSENING DEVICE FOR DRUM TENSION BOLT

(71) Applicant: HOSHINO GAKKI CO., LTD., Nagoya, Aichi (JP)

(72) Inventor: Satoshi Hirasawa, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 15/936,457

(22) Filed: Mar. 27, 2018

(65) Prior Publication Data

US 2019/0130881 A1 May 2, 2019

(30) Foreign Application Priority Data

Oct. 27, 2017 (JP) ..... 2017-208295

(51) Int. Cl.
*G10D 13/02* (2006.01)

(52) U.S. Cl.
CPC ..... *G10D 13/023* (2013.01)

(58) Field of Classification Search
CPC ..... G10D 13/023
USPC ..... 84/413
See application file for complete search history.

(56) References Cited

U.S. PATENT DOCUMENTS 6,459,026 B1 10/2002 Bozzio
2004/0081531 A1* 4/2004 Keane ..... F16B 39/10 411/119

* cited by examiner

*Primary Examiner* — Jianchun Qin

(57) ABSTRACT

An anti-loosening device includes a main body and an O-ring, which serves as an elastic member attached to the main body. The main body includes a fitting hole, into which the bolt head of a tension bolt is to be fitted, and eight holding sections, which laterally hold the bolt head fitted in the fitting hole. The holding sections are configured to open about the center line of the fitting hole and to laterally hold the bolt head fitted in the fitting hole.

9 Claims, 7 Drawing Sheets

ANTI-LOOSENING DEVICE FOR DRUM TENSION BOLT

CROSS-REFERENCE TO RELATED APPLICATION

This application is based upon and claims the benefit of priority from prior Japanese Patent Application No. 2017-208295, filed on Oct. 27, 2017, the entire contents of which are incorporated herein by reference.

BACKGROUND

The present invention relates to an anti-loosening device for a drum tensioner bolt.

A user fastens tension bolts to the lugs to attach a drumhead and a hoop to an open end of the shell. After attaching the drumhead, the user adjusts the tension of the drumhead by adjusting the degree of tightening of the tension bolts. However, vibrations generated during drumming can loosen the tension bolts, reducing the tension of the drumhead and changing the sound of the drum.

In this respect, a tension bolt anti-loosening device 100 as shown in FIGS. 8A and 8B is proposed. To prevent loosening of a tension bolt after adjusting the tension of the drumhead, the anti-loosening device 100 is attached to the bolt head TBH of the tension bolt and fitted between the bolt head TBH and the hoop H. When readjusting the tension of the drumhead, the user adjusts the degree of tightening of the tension bolt after removing the anti-loosening device 100 from the bolt head TBH, or with the anti-loosening device 100 attached to the bolt head TBH.

U.S. Pat. No. 6,459,026 proposes another example of a tension bolt anti-loosening device that is used with a specialized tension bolt. The anti-loosening device includes an upper annular section, which accommodates the bolt head, and a lower tubular section, which receives the shaft of the tension bolt. The upper annular section consists of four separate walls located on the outer circumference of the bolt head. The lower tubular section is configured to be fitted into an elongated hole formed in the hoop.

The bolt head includes a flange, which is brought into contact with the upper surface of the lower tubular section of the anti-loosening device. The outer circumferential surface of the flange includes serrations, which engage the inner circumference surface of the upper annular section of the anti-loosening device. The engagement between the lower tubular section and the elongated hole of the hoop limits rotation of the anti-loosening device relative to the hoop. In addition, the engagement between the serrations of the flange and the inner circumference surface of the upper annular section limits rotation of the tension bolt relative to the anti-loosening device. Such structures prevent loosening of the tension bolt while drumming.

However, the conventional anti-loosening devices have the following problems. When tuning the drum before drumming, the user frequently adjusts the degree of tightening of the tension bolt while attaching and removing the anti-loosening device to and from the tension bolt, or with the anti-loosening device attached to the tension bolt. Thus, when the anti-loosening device 100 shown in FIGS. 8A and 8B is used for a tension bolt having a bolt head TBH of a tetragonal cross section, for example, the corners of the bolt head TBH tend to deform and enlarge the circular hole 100*a*. Accordingly, the effect of the anti-loosening device 100 to limit loosening of the tension bolt gradually degrades in use.

Further, if the size of the corners of the bolt head TBH is small and thus the engagement between the corners of the bolt head TBH and the inner circumference surface defining the circular hole 100*a* is insufficient, the anti-loosening device 100 fails to properly limit loosening of the tension bolt. Moreover, if the anti-loosening device 100 is attached to a lower tension bolt, the anti-loosening device 100 tends to fall off the bolt head TBH. If the size of the corners of the bolt head TBH is large and thus the engagement between the corners of the bolt head TBH and the inner circumference surface defining the circular hole 100*a* is excessive, it would be difficult to perform the attachment and removal of the anti-loosening device 100 to and from the bolt head TBH and the adjustment of the degree of tightening of the tension bolt performed with the anti-loosening device 100 attached to the bolt head TBH.

The anti-loosening device disclosed in U.S. Pat. No. 6,459,026 publication requires a specialized tension bolt and a hoop with elongated holes to function as an anti-loosening device of a tension bolt. That is, the anti-loosening device is usable only with limited types of tension bolts and hoops. This reduces the versatility as an anti-loosening device for a tension bolt. In addition, once the anti-loosening device of the publication is attached to a tension bolt, the anti-loosening device is not removable from the tension bolt since the lower tubular section of the anti-loosening device is placed under the flange of the tension bolt.

SUMMARY

It is an objective of the present invention to provide an anti-loosening device for a drum tension bolt that limits loosening of the tension bolt regardless of the shape of the bolt head.

To achieve the foregoing objective and in accordance with one aspect of the present disclosure, an anti-loosening device for a drum tension bolt is provided that is configured to be attached to a tension bolt for adjusting tension of a drumhead. The anti-loosening device includes a main body configured to be in contact with a drum when attached to the tension bolt. The main body includes a fitting hole, into which a bolt head of the tension bolt is to be fitted, and a holding section, which is configured to laterally hold the tension bolt. The holding section is configured to open about a center line of the fitting hole.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

Referring to FIGS. 1 to 7B, an anti-loosening device for a drum tension bolt according to one embodiment of the present invention is now described.

Figure 1:
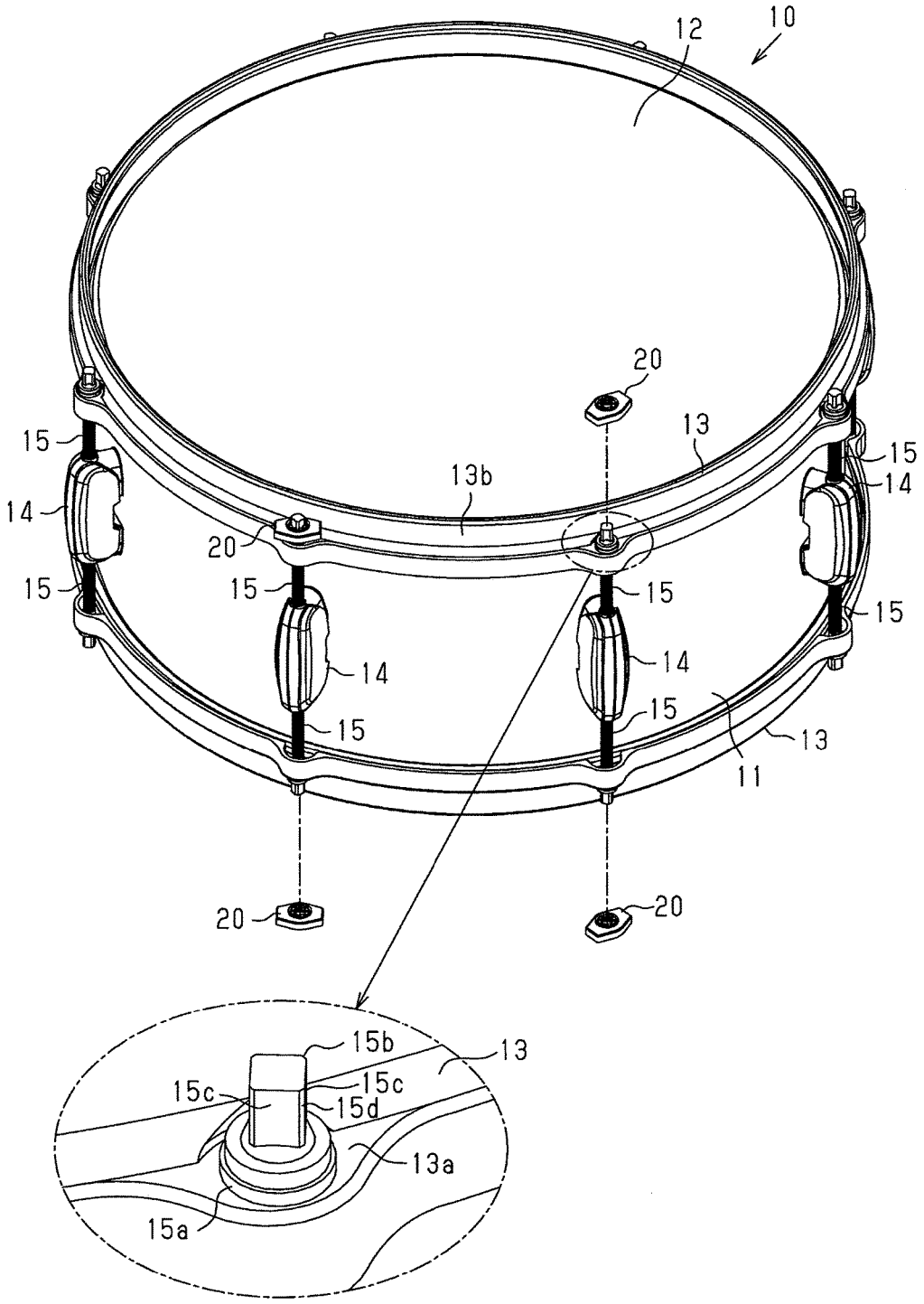
FIG. 1 is a perspective view showing a drum for which an anti-loosening device according to one embodiment of the present invention is used.
Figure 2:
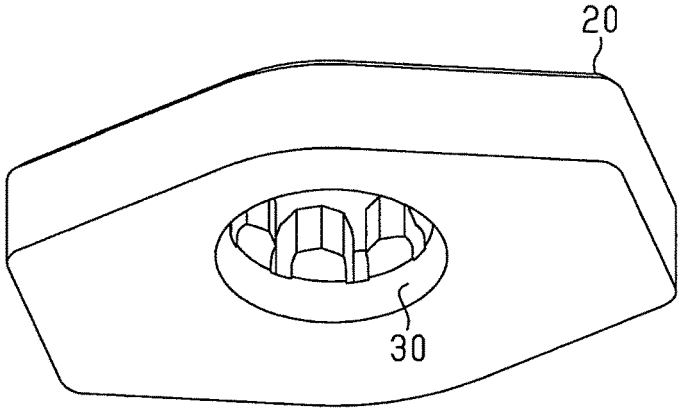
FIG. 2 is a perspective view showing the lower side of the anti-loosening device that is to be attached to a tension bolt.
Figure 2:
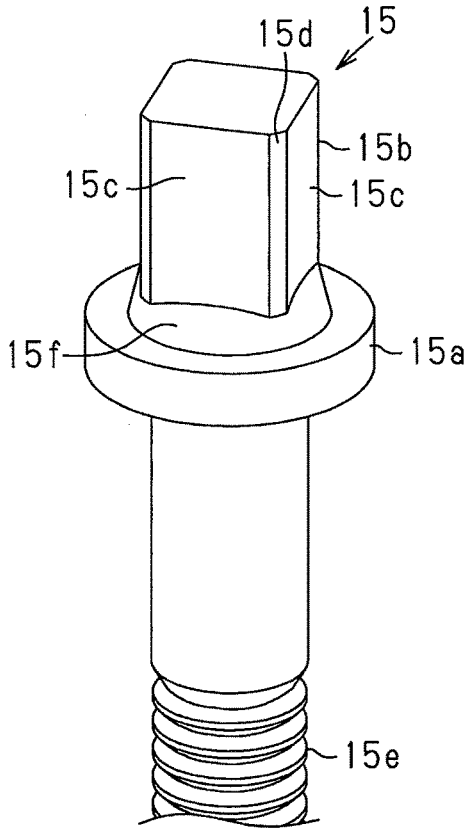

As shown in FIGS. 1 and 2, a drum 10 includes a cylindrical shell 11, drumheads 12, which close the open ends of the shell 11, and hoops 13, which are located on the outer side of the open ends of the shell 11. The drum 10 also includes a plurality of lugs 14 fixed at equal intervals on the outer circumferential surface of the shell 11 and a plurality of tension bolts 15 screwed into threaded holes in the upper and lower end surfaces of the lugs 14.

Each tension bolt 15 includes a flange 15*a*, which is in contact with the flange surface 13*a* of the hoop 13, a bolt head 15*b*, which may be held by a tool, and a threaded shaft 15*e*, which is screwed into a lug 14. The bolt head 15*b* has a substantially square cross section and includes four flat side surfaces 15*c* and four corners 15*d*. The bolt head 15*b* includes a proximal end 15*f*, which widens toward the flange 15*a*.

An anti-loosening device 20 is attached to the bolt head 15*b* of each tension bolt 15 to limit loosening of the tension bolt 15. When attached to the bolt head 15*b*, the anti-loosening device 20 is fitted between the bolt head 15*b* and the outer circumferential surface 13*b* of the hoop 13. The anti-loosening device 20 limits loosening of the tension bolt 15 by partially coming into contact with the outer circumferential surface 13*b* of the hoop 13. Anti-loosening devices 20 are attached to the upper tension bolts 15, which fix the upper drumhead 12 to the shell 11, from above the tension bolts 15. Anti-loosening devices 20 are attached to the lower tension bolts 15, which fix the lower drumhead 12 to the shell 11, from below the tension bolts 15.

Figure 3:
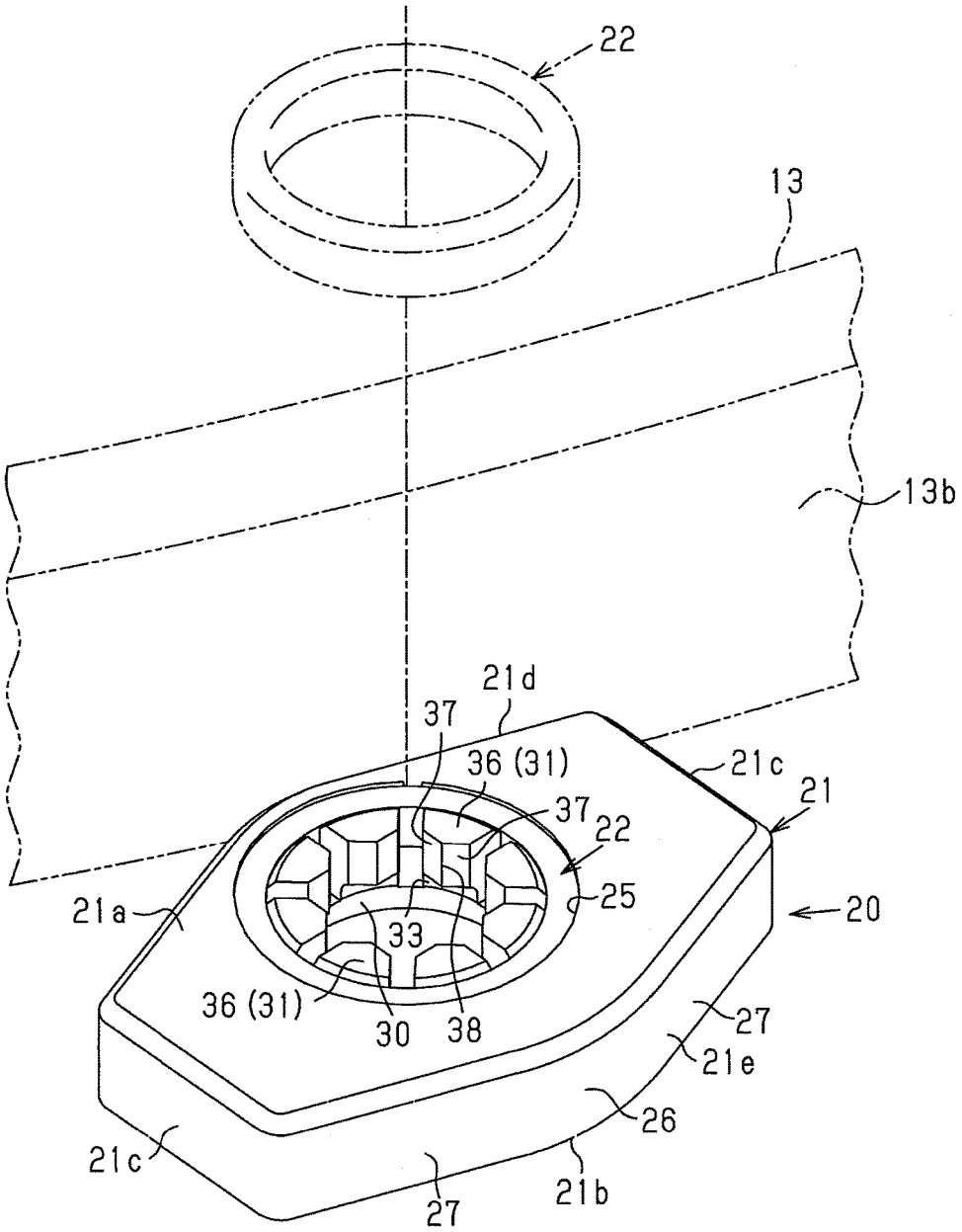
FIG. 3 is a perspective view showing the main body and the O-ring of the anti-loosening device.
Figure 4:
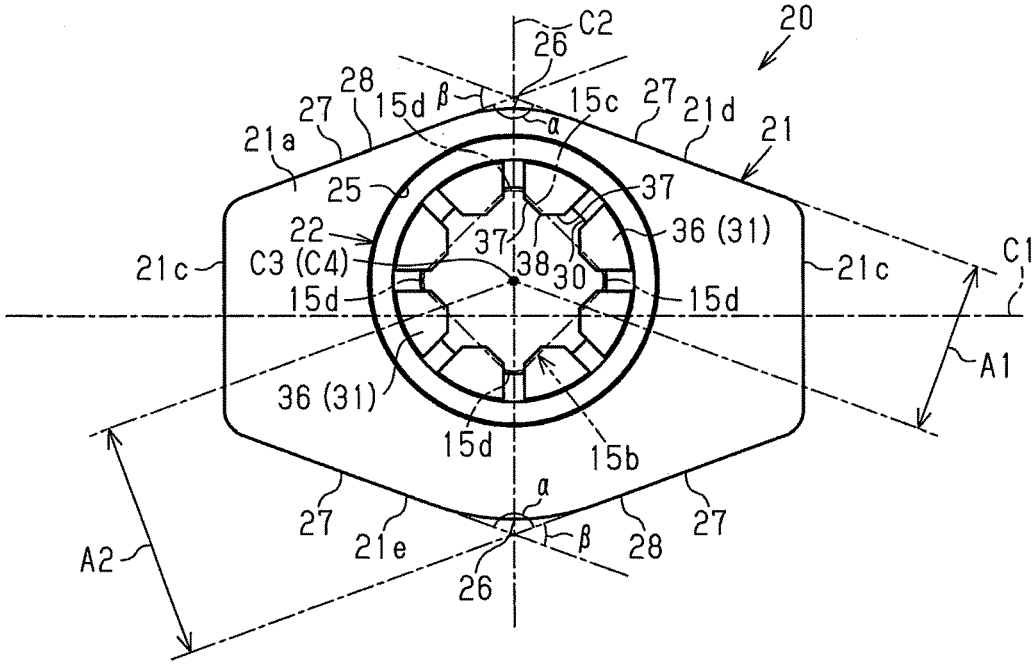
FIG. 4 is a plan view of the anti-loosening device.
Figure 5:
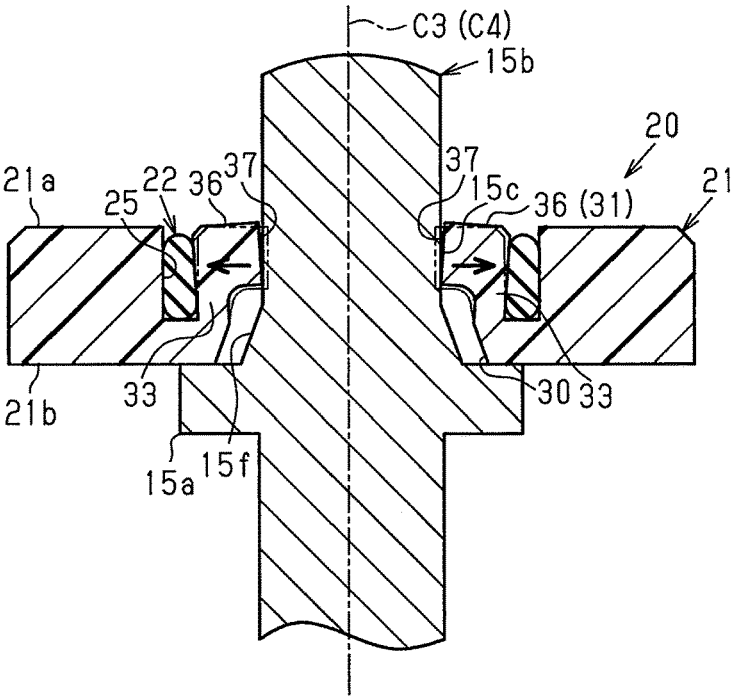
FIG. 5 is a vertical cross-sectional view of the anti-loosening device.

As shown in FIGS. 3 to 5, each anti-loosening device 20 includes a main body 21 and an O-ring 22, which serves as an elastic member attached to the main body 21. The main body 21 is made of a plastic and shaped as a plate having a predetermined thickness. Further, the main body 21 is flat and substantially has the shape of an elongated hexagon. The O-ring 22 is made of a rubber material having elasticity. The main body 21 has an upper surface 21*a*, which includes an annular recess 25, into which the O-ring 22 is fitted. The annular recess 25 has a depth that is about one-half to two-thirds of the thickness of the main body 21.

The main body 21 includes the upper surface 21*a* and a lower surface 21*b*, a pair of end sections 21*c* in the longitudinal direction, and a pair of outer side sections 21*d* and 21*e* in the width direction. The outer side sections 21*d* and 21*e* are symmetrical with respect to the longitudinal axis C1 of the main body 21. Each of the outer side sections 21*d* and 21*e* includes a rounded corner 26 and a pair of side surfaces 27 extending from the corner 26 to the end sections 21*c*. The two side surfaces 27 are symmetrical with respect to the lateral axis C2 passing through the corners 26 of the outer side sections 21*d* and 21*e*.

Each of the side surfaces 27 is a flat surface that is brought into contact with the outer circumferential surface 13*b* of the hoop 13 when the anti-loosening device 20 is attached to the tension bolt 15. When the angle formed by one of the side surfaces 27 with the other side surface 27 is $\alpha$, each of the outer side sections 21*d* and 21*e* has a clearance 28 having a permissible rotational angle $\beta$ of $(180-\alpha)$ degrees.

The main body 21 includes a fitting hole 30 and eight holding sections 31. The proximal end 15*f* of the bolt head 15*b* is fitted into the fitting hole 30. The fitting hole 30 is a circular hole, which opens in the lower surface 21*b* of the main body 21. The fitting hole 30 widens toward the lower surface 21*b* of the main body 21, in the same manner as the proximal end 15*f* of the bolt head 15*b*. The diameter of the fitting hole 30 is slightly larger than the diameter of the proximal end 15*f* of the bolt head 15*b*. This forms a space between the inner circumference surface defining the fitting hole 30 and the proximal end 15*f* of the bolt head 15*b*.

The fitting hole 30 is formed on the inner side of the annular recess 25 and arranged to be coaxial with the annular recess 25. The fitting hole 30 and the annular recess 25 are eccentric with respect to the center of the main body 21. Thus, when one of the outer side sections 21*d* and 21*e* is the first outer side section 21*d* and the other is the second outer side section 21*e*, the center line C3 of the fitting hole 30 is closer to the first outer side section 21*d* than to the second outer side section 21*e*. The distance A1 between the center line C3 of the fitting hole 30 and the first outer side section 21*d* is less than the distance A2 between the center line C3 of the fitting hole 30 and the second outer side section 21*e*.

The eight holding sections 31 are formed individually in the main body 21. The eight holding sections 31 are identical in shape and dimensions. Each holding section 31 is a section of the main body 21 located between the fitting hole 30 and the annular recess 25. The holding sections 31 are arranged at regular intervals around the center line C3 of the fitting hole 30. In addition, the holding sections 31 face the center line C3 of the fitting hole 30 and are arranged at an angular pitch of 45 degrees.

The holding sections 31 are configured to open about the center line C3 of the fitting hole 30 when pressed and moved laterally outward by the bolt head 15*b* fitted in the fitting hole 30. The holding sections 31 are configured to laterally hold the bolt head 15*b* fitted in the fitting hole 30. In addition, the holding sections 31 are configured to elastically hold the bolt head 15*b*, together with the O-ring 22 in the annular recess 25.

Each holding section 31 includes a flexible section 33 and a jaw 36 located on the distal end of the flexible section 33. The dimension of the flexible section 33 in the thickness direction of the main body 21 is equal to the depth of the annular recess 25. As such, the flexible section 33 has a length that is about one-half to two-thirds of the thickness of the main body 21, as with the annular recess 25. The flexible section 33 is able to bend toward and away from the center line C3 of the fitting hole 30.

The flexible section 33 generally extends away from the center line C3 of the fitting hole 30 from the distal end to the proximal end. The proximal end of the flexible section 33 is continuous with the inner circumference surface defining the fitting hole 30. Thus, the space between the flexible section 33 and the bolt head 15*b* is continuous with the space between the inner circumference surface defining the fitting hole 30 and the bolt head 15*b*.

The jaws 36 project from the distal ends of the flexible sections 33 toward the center line C3 of the fitting hole 30. Each jaw 36 has a pair of left and right holding surfaces 37 for holding side surfaces 15*c* of the bolt head 15*b*. Each holding surface 37 is a flat surface that is brought into surface contact with a side surface 15*c* of the bolt head 15*b*. The two holding surfaces 37 are symmetrical with respect to the ridge line 38 at the distal end of the jaw 36.

The holding sections 31 are arranged such that the holding surfaces 37 are spaced apart from the center line C3 of the fitting hole 30 by a predetermined distance. When the anti-loosening device 20 is not attached to the tension bolt 15, the distance between the center line C3 of the fitting hole 30 and the holding surfaces 37 of the jaws 36 is less than the distance between the axis C4 of the tension bolt 15 and the side surfaces 15*c* of the bolt head 15*b*. The holding sections 31 are arranged at predetermined positions that allow the holding sections 31 to hold sections of the bolt head 15*b* near the corners 15*d*, that is, the edge sections in the width direction of the side surfaces 15*c* of the bolt head 15*b*.

In addition, the holding sections 31 are arranged such that the holding surface 37 of a holding section 31 is perpendicular to the holding surface 37 of the adjacent holding section 31. The two holding surfaces 37 of the adjacent holding sections 31 define a holding space in which sections of the bolt head 15*b* near a corner 15*d* are located. The anti-loosening device 20 has eight such holding spaces arranged at intervals of 45 degrees around the center line C3 of the fitting hole 30. As such, the position of the anti-loosening device 20 relative to the bolt head 15*b* having a square cross section may be changed by 45 degrees at a time when attaching the anti-loosening device 20 to the bolt head 15*b*. Further, while the anti-loosening device 20 limits loosening of the tension bolt 15, the tension bolt 15 is rotatable in intervals of 45 degrees.

Referring to FIGS. 1 and 5 to 7B, the operation of the anti-loosening device 20 is now described.

As shown in FIG. 1, the user attaches the drumheads 12 together with the hoops 13 to the open ends of the shell 11 by fastening all the tension bolts 15 to the lugs 14. After attaching each drumhead 12 to the shell 11, the user adjusts the tension of the drumhead 12 by adjusting the degree of tightening of the tension bolts 15. After adjusting the tension of the drumhead 12, the user attaches an anti-loosening device 20 to each tension bolt 15 to limit loosening of the tension bolt 15.

When the tension bolts 15 are fastened to the lugs 14, the bolt heads 15*b* are in random orientations. Thus, there may be a case in which the anti-loosening device 20 cannot be attached to the bolt head 15*b* in the orientation shown in the solid lines in FIGS. 6A and 6B. In this case, as shown in FIG. 4 and indicated by the long dashed double-short dashed lines in FIGS. 6A and 6B, the anti-loosening device 20 is rotated within the range up to the permissible rotational angle β of the clearance 28 from the position indicated by the solid lines so as to be attachable to the bolt head 15*b*. Further, the position of the anti-loosening device 20 relative to the bolt head 15*b* may be changed by 45 degrees at a time when attaching the anti-loosening device 20 to the bolt head 15*b*. This structure allows the user to attach the anti-loosening device 20 to the bolt head 15*b*, which is in a random orientation.

As described above, the anti-loosening device 20 is attached to the bolt head 15*b* with a gap formed between the anti-loosening device 20 and the outer circumferential surface 13*b* of the hoop 13. The maximum size of the gap corresponds to the permissible rotational angle β of the clearance 28. The vibrations generated while the drum 10 is played gradually loosen and accordingly rotate the tension bolt 15 in the counterclockwise direction as viewed in FIGS. 6A and 6B. When attached to the bolt head 15*b* in the first orientation shown in FIG. 6A, the anti-loosening device 20 rotates together with the tension bolt 15 until a side surface 27 of the first outer side section 21*d* comes into contact with the outer circumferential surface 13*b* of the hoop 13. When attached to the bolt head 15*b* in the second orientation shown in FIG. 6B, the anti-loosening device 20 rotates together with the tension bolt 15 until a side surface 27 of the second outer side section 21*e* comes into contact with the outer circumferential surface 13*b* of the hoop 13. Once the side surface 27 of the first outer side section 21*d* or the second outer side section 21*e* is in contact with the outer circumferential surface 13*b* of the hoop 13, the hoop 13 blocks further rotation of the anti-loosening device 20, thereby limiting loosening of the tension bolt 15.

Figure 6A:
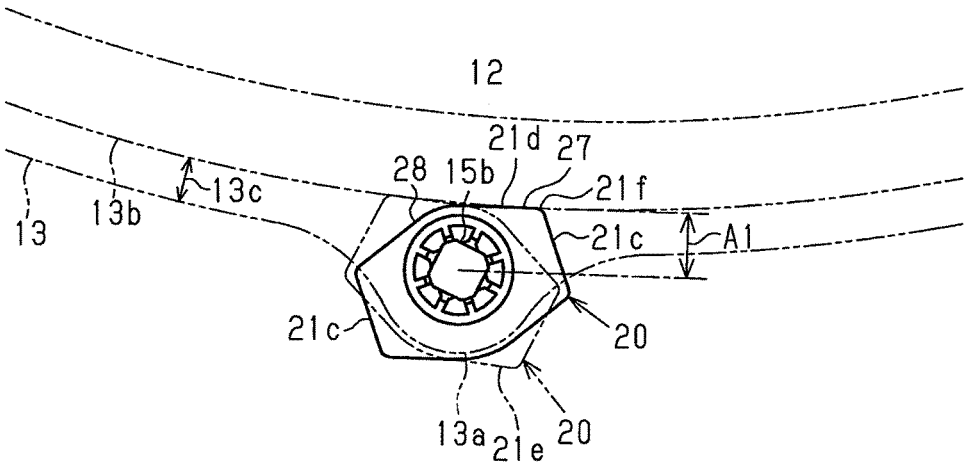
FIG. 6A is a plan view showing the anti-loosening device attached to the tension bolt in the first orientation.
Figure 6B:
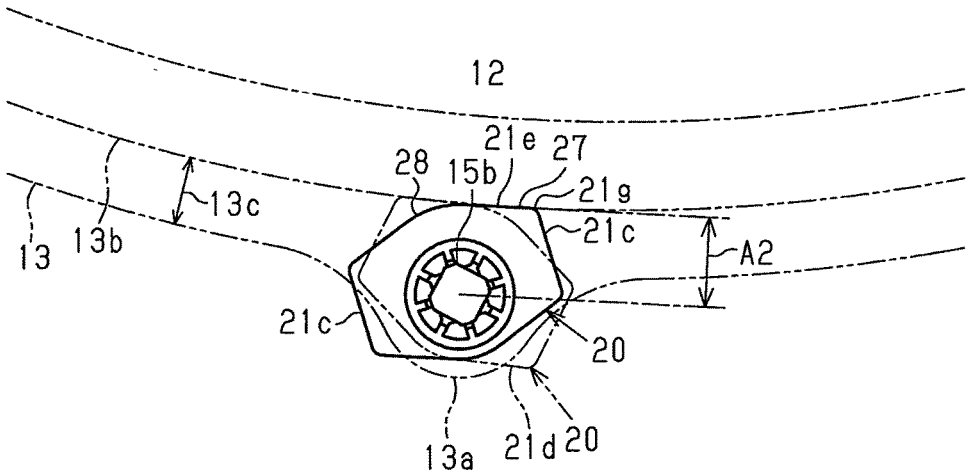
FIG. 6B is a plan view showing the anti-loosening device attached to the tension bolt in the second orientation.

When the anti-loosening device 20 is attached to the bolt head 15*b* as indicated by the long dashed double-short dashed lines in FIG. 6A or FIG. 6B, the tension bolt 15 loosens to the extent corresponding to the permissible rotational angle β of the clearance 28 of the anti-loosening device 20. Since the loosening of the tension bolt 15 reduces the tension of the drumhead 12 and affects the drumming sound, the permissible rotational angle β of the clearance 28 is preferably set to the smallest possible value. Further, since the angle of the anti-loosening device 20 relative to the bolt head 15*b* can be changed by 45 degrees at a time when attaching the anti-loosening device 20 to the bolt head 15*b*, the permissible rotational angle β of the clearance 28 does not have to be greater than 45 degrees.

The orientation in which the anti-loosening device 20 is attached to bolt head 15*b* is determined by the type of the hoop 13. For example, when the distance between the bolt insertion hole and the outer circumferential surface 13*b* of the hoop 13 is greater than or equal to the distance A1 and less than the distance A2 of the anti-loosening device 20, the anti-loosening device 20 is attached to the bolt head 15*b* in the first orientation shown in FIG. 6A. When the distance between the bolt insertion hole and the outer circumferential surface 13*b* of the hoop 13 is equal to the distance A1 of the anti-loosening device 20, as shown in FIG. 6A, the anti-loosening device 20 rotates until a side surface 27 of the first outer side section 21*d* comes into surface contact with the outer circumferential surface 13*b* of the hoop 13, and then limits loosening of the tension bolt 15. When the distance between the bolt insertion hole and the outer circumferential surface 13*b* of the hoop 13 is slightly greater than the distance A1 of the anti-loosening device 20, the anti-loosening device 20 rotates until the corner 21*f* between the first outer side section 21*d* and the end section 21*c* comes into point contact with the outer circumferential surface 13*b* of the hoop 13, and then limits loosening of the tension bolt 15.

Further, when the distance between the bolt insertion hole and the outer circumferential surface 13*b* of the hoop 13 is greater than or equal to the distance A2 of the anti-loosening device 20, the anti-loosening device 20 is attached to the bolt head 15*b* in the second orientation shown in FIG. 6B. When the distance between the bolt insertion hole and the outer circumferential surface 13*b* of the hoop 13 is equal to the distance A2 of the anti-loosening device 20, the anti-loosening device 20 rotates until a side surface 27 of the second outer side section 21*e* comes into surface contact with the outer circumferential surface 13*b* of the hoop 13, and then limits loosening of the tension bolt 15. When the distance between the bolt insertion hole and the outer circumferential surface 13*b* of the hoop 13 is slightly greater than the distance A2 of the anti-loosening device 20, the anti-loosening device 20 rotates until the corner 21*g* between the second outer side section 21*e* and the end section 21*c* comes into point contact with the outer circumferential surface 13*b* of the hoop 13, and then limits loosening of the tension bolt 15.

When the anti-loosening device 20 is attached to the bolt head 15*b*, as indicated by the arrows in FIG. 5, the side surfaces 15*c* of the bolt head 15*b* press and move the holding sections 31 laterally outward. The holding sections 31 are thus deformed to open about the center line C3 of the fitting hole 30. At this time, the holding sections 31 compress the O-ring 22 in the annular recess 25, and the compression creates an elastic force in the O-ring 22. This allows the holding sections 31, which are opened conforming to the shape of the bolt head 15*b*, to elastically grip the bolt head 15*b* in the lateral direction together with the O-ring 22. As such, the anti-loosening device 20 is able to reliably hold the bolt head 15*b* fitted in the fitting hole 30 even if there are dimensional variations or errors in the shape of the sections of the bolt head 15*b* near the corners 15*d*.

Figure 7A:
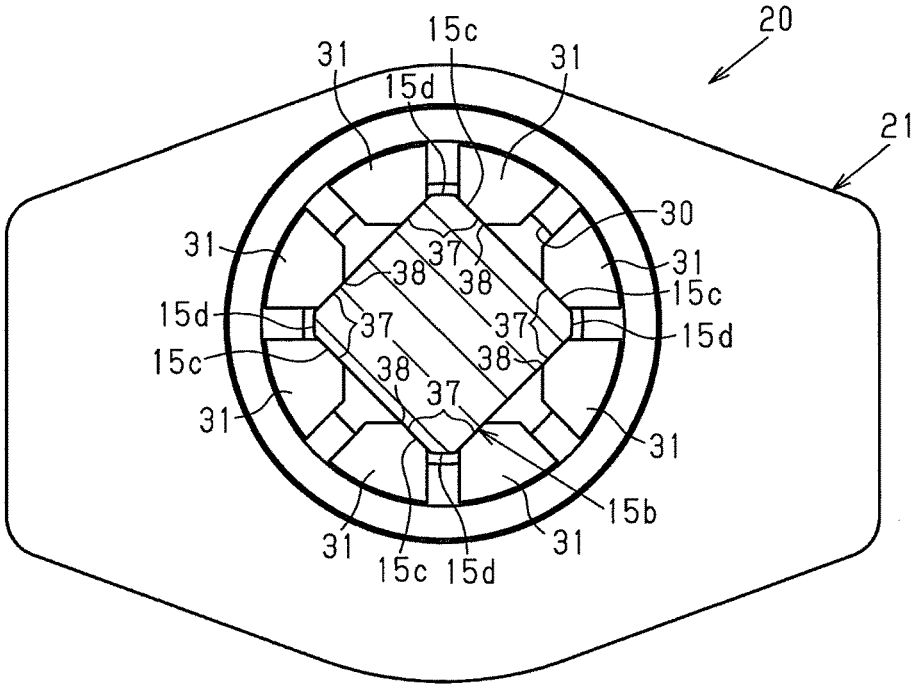
FIG. 7A is a plan view showing the anti-loosening device holding the bolt head of the tension bolt.
Figure 7B:
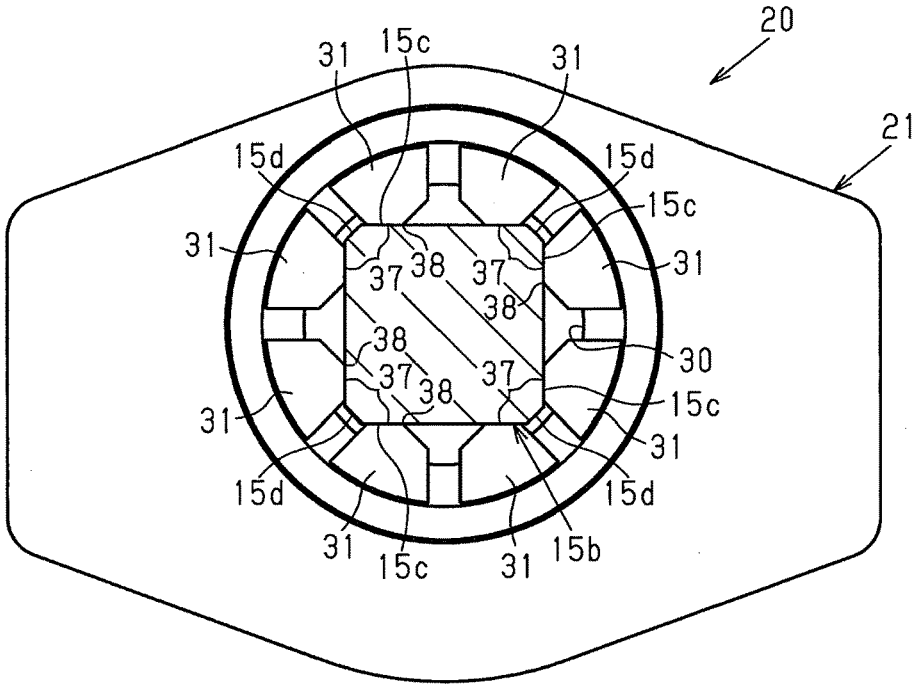
FIG. 7B is a plan view showing the anti-loosening device with the tension bolt rotated from the original position by 45 degrees.
Figure 8A:
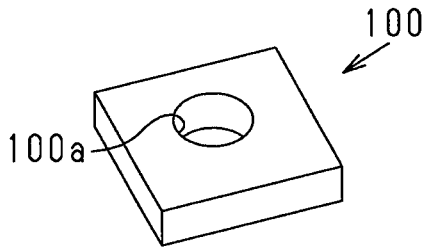
Fig.8A (Related Art)
FIG. 8A is a perspective view showing a conventional anti-loosening device.
Figure 8B:
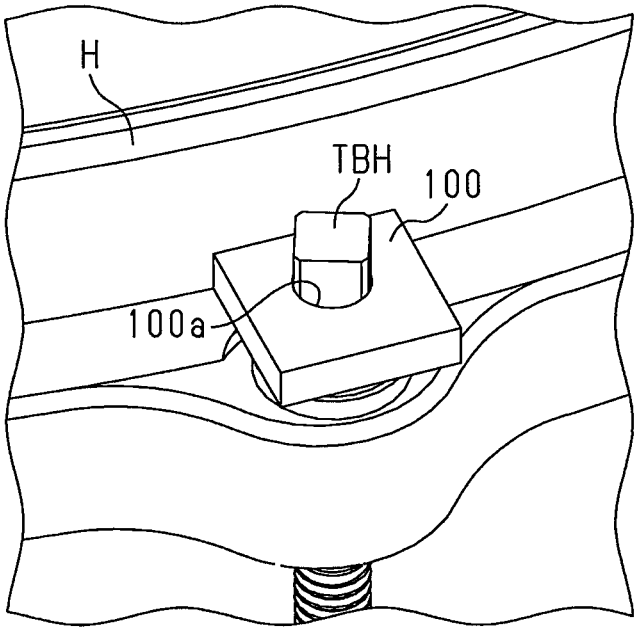
Fig.8B (Related Art)
FIG. 8B is a perspective view showing the anti-loosening device attached to a tension bolt.

To readjust the tension of the drumhead 12, the user readjusts the degree of tightening of each tension bolt 15 with the anti-loosening device 20 attached to the bolt head 15*b*. As shown in FIGS. 7A and 7B, the bolt head 15*b* is held by the eight holding sections 31 arranged around the fitting hole 30 at intervals of 45 degrees. This allows the user to rotate the tension bolt 15 held by the holding sections 31 by 45 degrees at a time.

Each time the tension bolt 15 is rotated by 45 degrees, the flexible sections 33 bend so that the holding sections 31 move toward and away from the center line C3 of the fitting hole 30. This allows each corner 15*d* of the bolt head 15*b* to smoothly move over the ridge line 38 from one of the holding surfaces 37 of the corresponding holding section 31 to the other holding surface 37, or in the opposite direction.

The sections of the side surfaces 15*c* near each corner 15*d* of the bolt head 15*b* are held by two holding surfaces 37 of the adjacent holding sections 31. In other words, each holding section 31 uses one of a pair of holding surfaces 37 to hold an edge section in the width direction of a side surface 15*c* of the bolt head 15*b*. This minimizes the travel in the lateral direction of the holding surfaces 37 when the tension bolt 15 is rotated, allowing the user to tighten and loosen the tension bolt 15 without applying excessive force. Accordingly, the degree of tightening of the tension bolt 15 may be easily adjusted with the anti-loosening device 20 attached to the tension bolt 15.

Accordingly, the above described embodiment achieves the following advantages.

(1) The holding sections 31 are configured to open about the center line C3 of the fitting hole 30 and to laterally hold the bolt head 15*b* fitted in the fitting hole 30. Thus, when the anti-loosening device 20 is attached to the tension bolt 15, the holding sections 31 are pressed and moved laterally outward by the bolt head 15*b* and open about the center line C3 of the fitting hole 30. The holding sections 31 hold the bolt head 15*b* laterally while being opened conforming to the shape of the bolt head 15*b*. As a result, in addition to the advantage that the attachment and removal of the anti-loosening device 20 to and from the tension bolt 15 are easy regardless of the shape of the bolt head 15*b*, the anti-loosening device 20 has a higher durability against repeated attachment and removal. In addition, the anti-loosening device 20 resists falling off from the bolt head 15*b* when the anti-loosening device 20 is attached to a lower tension bolt 15. As such, loosening of the tension bolt 15 is limited regardless of the shape of the bolt head 15*b*.

(2) When the anti-loosening device 20 is not attached to the tension bolt 15, the distance between the center line C3 of the fitting hole 30 and the holding surfaces 37 of the jaws 36 is less than the distance between the axis C4 of the tension bolt 15 and the side surfaces 15*c* of the bolt head 15*b*. This structure ensures that the holding sections 31 are in contact with the side surfaces 15*c* of the tension bolt 15 when the anti-loosening device 20 is attached to the tension bolt 15. The force of the holding sections 31 holding the tension bolt 15 is thus reliably transmitted to the side surfaces 15*c* of the bolt head 15*b* from the holding sections 31, enabling effective limitation of loosening of the tension bolt 15.

The holding surfaces 37 of the holding sections 31 are flat. This ensures that, when the tension bolt 15 has a polygonal cross section, the flat holding surfaces 37 of the holding sections 31 of the anti-loosening device 20 attached to the tension bolt 15 are brought into surface contact with the flat side surfaces 15*c* of the tension bolt 15. Accordingly, the force of the holding sections 31 holding the tension bolt 15 is reliably transmitted to the side surfaces 15*c* of the tension bolt 15 from the holding surfaces 37. Further, a tension bolt 15 having a polygonal cross section has relatively low dimensional variations in the side surfaces 15*c*. As such, the anti-loosening device 20 has a greater versatility than a structure in which the holding sections 31 hold only the corners 15*d* of the bolt head 15*b*.

(3) The holding sections 31 are positioned so as to hold the end sections 21*c* in the width direction of the side surfaces 15*c* of the bolt head 15*b*. This structure reduces the travel in the lateral direction of the holding surfaces 37 when the tension bolt 15 is rotated with the anti-loosening device 20 attached to the tension bolt 15, as compared to a structure in which the holding sections 31 hold the center in the width direction of the side surfaces 15*c* of the bolt head 15*b*. This allows the force of the holding sections 31 limiting loosening of the tension bolt 15 to be set to the optimum magnitude that enables the limitation of loosening of the tension bolt 15 while the drum 10 is played and yet enables the adjustment of the degree of tightening of the tension bolt 15 while the tension of the drumhead 12 is adjusted.

(4) Each holding section 31 uses one of a pair of holding surfaces 37 to hold a side surface 15*c* of the bolt head 15*b*. This structure allows the rotational position of the tension bolt 15 that is held by one of the holding surfaces 37 of each holding section 31 to be different from the rotational position of the tension bolt 15 that is held by the other holding surface 37 of the holding section 31. That is, as compared to a structure in which each holding section 31 has only one holding surface, the holding sections 31 can hold the tension bolt 15 in a greater number of rotational positions within one turn of the tension bolt 15. This allows the tension bolt 15 to be rotated in smaller intervals while the anti-loosening device 20 limits loosening of the tension bolt 15, enabling fine adjustment of the tension of the drumhead 12.

(5) Each holding section 31 includes a flexible section 33 and a jaw 36 located on the distal end of the flexible section 33. As such, the flexible sections 33 bend so that the holding sections 31 are pressed and moved laterally outward by the side surfaces 15*c* of the bolt head 15*b*, and the holding sections 31 elastically hold the tension bolt 15 in the lateral direction. The flexible sections 33 are shaped to extend in the thickness direction of the main body 21, resulting in the longer holding sections 31, which are easier to bend. This increases the durability of the holding sections 31. In addition, the width of the holding sections 31 may be reduced to increase the number of the holding sections 31. This further increases the durability of the holding sections 31.

(6) The flexible section 33 generally extends away from the center line C3 of the fitting hole 30 from the distal end to the proximal end. This forms a space between the section near the proximal end 15*f* of the bolt head 15*b* and the holding sections 31. As such, the anti-loosening device 20 attached to the tension bolt 15 is unlikely to interfere with the proximal end 15*f* of the bolt head 15*b*. This allows the anti-loosening device 20 to be easily used with a tension bolt 15 having a bolt head 15*b* of a different shape, further increasing the versatility of the anti-loosening device 20.

(7) Each holding section 31 is a section of the main body 21 located between the fitting hole 30 and the annular recess 25. The structure in which the main body 21 has the annular recess 25 around the holding sections 31 and the section between the fitting hole 30 and the annular recess 25 functions as the holding sections 31 allows the holding sections 31 to be formed using the thickness of the main body 21. This allows the anti-loosening device 20 to have a small thickness, facilitating holding of the bolt head 15*b* by a tool or other means. Accordingly, the degree of tightening of the tension bolt 15 may be easily adjusted with the anti-loosening device 20 attached to the tension bolt 15.

(8) The anti-loosening device 20 includes the O-ring 22 attached to the main body 21. As such, when the tension bolt 15 is fitted into the fitting hole 30, the holding sections 31 are pressed and moved outward around the center line C3 of the fitting hole 30 and also compress the O-ring 22 in the annular recess 25. The compression produces elastic force in the O-ring 22. The elastic force of the O-ring 22 is used as the force for limiting loosening of the tension bolt 15, thereby further improving the effectiveness as an anti-loosening device for a tension bolt.

(9) When the angle formed by one of the side surfaces 27 with the other side surface 27 of an outer side section 21*d* or 21*e* of the anti-loosening device 20 is $\alpha$, the outer side section 21*d* or 21*e* has a clearance 28, which has a permissible rotational angle $\beta$ of $(180-\alpha)$ degrees. As described above, when the anti-loosening device 20 is attached to the tension bolt 15, the orientation of the anti-loosening device 20 may be changed by up to the permissible rotational angle $\beta$ of the clearance 28. This allows the anti-loosening device 20 to be attached to the tension bolt 15 regardless of the rotational position of the tension bolt 15.

The present embodiment may be modified as follows.

The cross-sectional shape of the bolt head 15*b* may be modified to any polygonal shape, such as a rectangular shape and a hexagonal shape.

The number of the holding sections 31 may be modified according to the size and shape of the tension bolt 15.

The pair of the holding surfaces 37 of each holding section 31 may be modified to a single flat surface.

Further, the pair of holding surfaces 37 may be modified to a curved surface having an arcuate cross section.

The holding sections 31 may hold sections of the side surfaces 15*c* of the bolt head 15*b* other than the edge sections in the width direction.

The holding sections 31 do not have to include the jaws 36. In this case, the holding sections 31 only need to be shaped such that the flexible sections 33 directly hold the bolt head 15*b*. The shape of the holding sections 31 may be modified according to the size and shape of the tension bolt 15.

The holding sections 31 may extend from the upper surface 21*a* of the main body 21.

The holding sections 31 may be a separate component from the main body 21. In this case, the anti-loosening device 20 only needs to be assembled by coupling the holding sections 31 to the main body 21.

The limitation of loosening of the tension bolt 15 by the anti-loosening device 20 may be achieved by bringing the main body 21 into contact with a section other than the hoop 13, for example, with the outer circumferential surface of the shell 11.

Instead of the O-ring 22, any elastic member, such as a spring or a sponge, may be used.

The anti-loosening device 20 does not have to include the O-ring 22 serving as the elastic member.

The planar shape of the main body 21 does not have to be hexagonal and may be any polygonal shape. The planar shape of the main body 21 may be asymmetrical with respect to the longitudinal axis C1 or symmetrical with respect to the lateral axis C2. That is, the main body 21 may have any structure as long as it includes a contact section that is brought into contact with a given section of the drum 10.

The clearance 28 of the anti-loosening device 20 may be omitted. In this case, the outer side sections 21*d* and 21*e* of the anti-loosening device 20 may be linear.

The main body 21 may be made of a metal material.

The invention claimed is:

1. An anti-loosening device for a drum tension bolt that is configured to be attached to a tension bolt for adjusting tension of a drumhead, the anti-loosening device comprising a main body configured to be in contact with a drum when attached to the tension bolt, wherein the main body includes a fitting hole, into which a bolt head of the tension bolt is to be fitted, and a holding section, which is configured to laterally hold the tension bolt, and the holding section is configured to open about a center line of the fitting hole and elastically grip the bolt head of the tension bolt, and wherein the holding section includes a flexible section, which extends in a thickness direction of the main body, and a jaw, which projects from a distal end of the flexible section toward the center line of the fitting hole.

2. The anti-loosening device for a drum tension bolt according to claim 1, wherein a distance between the center line of the fitting hole and the holding section is less than a distance between an axis of the tension bolt and a side surface of the tension bolt.

3. The anti-loosening device for a drum tension bolt according to claim 1, wherein the holding section includes a flat holding surface, and the holding section is configured to hold a flat side surface of the tension bolt having a polygonal cross section with the holding surface.

4. The anti-loosening device for a drum tension bolt according to claim 3, wherein the holding section is configured to hold an edge section in a width direction of the side surface of the tension bolt with the holding surface.

5. The anti-loosening device for a drum tension bolt according to claim 3, wherein the holding surface is one of a pair of holding surfaces, and the holding section is configured to hold the side surface of the tension bolt with one of the pair of holding surfaces.

6. The anti-loosening device for a drum tension bolt according to claim 1, wherein the holding section extends away from the center line of the fitting hole from the distal end to a proximal end of the flexible section.

7. The anti-loosening device for a drum tension bolt according to claim 1, wherein the main body includes a recess, which is located around the holding section and has a depth in a thickness direction of the main body, and the holding section is a section of the main body between the fitting hole and the recess.

8. The anti-loosening device for a drum tension bolt according to claim 7, wherein the recess receives an elastic member.

9. The anti-loosening device for a drum tension bolt according to claim 1, wherein the main body includes an outer side section configured to be in contact with the drum when the main body is attached to the tension bolt, and the outer side section has a clearance having a permissible rotational angle in a rotational direction of the tension bolt.

* * * * *